US005644809A

United States Patent [19]

Olson

[11] Patent Number: 5,644,809

[45] Date of Patent: Jul. 8, 1997

[54] CERVICAL PILLOW

[76] Inventor: Michael J. Olson, 710 Maple Leaf Ct., Osceola, Wis. 54020

[21] Appl. No.: 648,426

[22] Filed: May 15, 1996

[51] Int. Cl.[6] ..... A47G 9/02

[52] U.S. Cl. ..... 5/636; 5/639

[58] Field of Search ..... 5/636, 639, 643, 5/645, 646

[56] References Cited

U.S. PATENT DOCUMENTS

| | | | |
|---|---|---|---|
| 2,782,427 | 2/1957 | Ericson . | |
| 3,829,917 | 8/1974 | De Laittre et al. | 5/636 |
| 3,883,906 | 5/1975 | Sumpter . | |
| 4,235,472 | 11/1980 | Sparks . | |
| 4,821,355 | 4/1989 | Burkhardt | 5/636 |
| 5,018,231 | 5/1991 | Wang . | |
| 5,214,814 | 6/1993 | Eremita et al. . | |

*Primary Examiner*—Michael F. Trettel
*Attorney, Agent, or Firm*—Palmatier, Sjoquist, Helget & Voigt, P.A.

[57] ABSTRACT

The present invention is a cervical pillow designed to be used by people while they sleep. The cervical pillow comprises a top portion having a neck support and a head support. A shoulder ledge extends from the top portion along the front edge of the pillow to accommodate the sleeper's shoulder when the sleeper rolls to one side. The cervical pillow has a V-shaped pocket formed in the bottom portion of the pillow under the shoulder ledge to accommodate a sleeper's shoulder. A first and second arm channel extends angularly from the V-shaped pocket to accommodate the sleeper's arm as the arm is extended under the pillow. Each arm channel has a shoulder opening in communication with the V-shaped pocket and a hand end which may extend to the back edge of the pillow adjacent to a side edge. Each arm channel is formed at an angle relative to the front of the pillow. A central prop portion extends from the bottom portion of the pillow between the arm channels to support the sleeper's head while allowing the sleeper's arm to extend through the arm channel. A peripheral prop portion is on the bottom portion of the pillow between each arm channel and the adjacent edge of the pillow. The peripheral prop portion and the central prop portion allow the arm channel to maintain its shape when the sleeper's head is on the head support and prevent the arm channel from collapsing and reducing the circulation in the sleeper's arm.

20 Claims, 2 Drawing Sheets

CERVICAL PILLOW

BACKGROUND OF THE INVENTION

The present invention is a pillow designed to be used to maintain proper cervical and thoracic spinal alignment of people as they sleep. The present invention also provides proper temporomandibular joint alignment regardless of whether the person is sleeping on their back or on their side with arms either in front the body or with the lower arm extended under the pillow.

Previous pillows are generally designed to hold an arm, neck or shoulder in a predefined position for therapeutic conditions. These pillows do not accommodate a sleeper who may sleep on one side and extend the lower arm under the sleeper's head. This sleeping position causes the arm to raise the pillow under the sleeper's head changing the sleeper's neck and jaw alignment. This change in alignment is known to cause problems with the sleeper's health.

Furthermore, a pillow design is needed wherein the sleeper may sleep on either the left or right side and extend the lower arm under the pillow at a natural angle from the shoulder to a position in front of the body. The previous pillows do not disclose a design which will accommodate the extension of the lower arm while maintaining proper spinal and joint alignment.

The present invention is designed to address these deficiencies in the prior art while providing a pillow which may be inserted into a standard pillow case.

SUMMARY OF THE INVENTION

The present invention is a cervical pillow designed to be used by people while they sleep. The cervical pillow comprises a top portion having a neck support and a head support. A shoulder ledge extends from the top portion along the front edge of the pillow to accommodate the sleeper's shoulder when the sleeper rolls to one side. The cervical pillow has a V-shaped pocket formed in the bottom portion of the pillow under the shoulder ledge to accommodate a sleeper's shoulder. A first and second arm channel extends angularly from the V-shaped pocket to accommodate the sleeper's arm as the arm is extended under the pillow. Each arm channel has a shoulder opening in communication with the V-shaped pocket and a hand end which may extend to the back edge of the pillow adjacent to a side edge. Each arm channel is formed at an angle relative to the front of the pillow. A central prop portion extends from the bottom portion of the pillow between the arm channels to support the sleeper's head while allowing the sleeper's arm to extend through the arm channel. A peripheral prop portion is on the bottom portion of the pillow between each arm channel and the adjacent edge of the pillow. The peripheral prop portion and the central prop portion allow the arm channel to maintain its shape when the sleeper's head is on the head support and prevent the arm channel from collapsing and reducing the circulation in the sleeper's arm.

A feature of the present invention is a second arm channel formed at an angle to the front of the pillow to accommodate a sleeper's left arm in a natural orientation extending under the pillow while maintaining the head and neck in a proper alignment position.

Another feature of the present invention is a first arm channel formed at an angle to the front of the pillow to accommodate a sleeper's right arm in a natural orientation under the pillow.

Another feature of the present invention is a V-shaped pocket between the first and second arm channels to accommodate the sleeper's shoulder to reduce loss of circulation while the sleeper's arm is extended under the pillow.

Another feature of the present invention is several prop portions extending from the bottom portion of the pillow to support each arm channel to prevent the arm channel from collapsing, causing pressure and loss of circulation to the sleeper's arm.

Another feature of the present invention is an arm cavity formed by placing the pillow on a bed.

Another feature of the present invention is the first arm channel and second arm channel are formed in a V-orientation to each other to accommodate the natural extension of either of the sleeper's arms.

Another feature of the present invention is a shoulder ledge extending from the top portion of the pillow to accommodate the sleeper's shoulder and reduce pressure on the shoulder and loss of circulation as the sleeper sleeps on one side.

An advantage of the present invention is a design which accommodates a sleeper sleeping on the sleeper's back or on either side with arms in front of the sleeper or with the lower arm extending under the pillow while maintaining proper spinal and jaw joint alignment.

An advantage of the present invention is a design which accommodates a standard pillow case.

Another advantage of the present invention is a design which reduces pressure on the sleeper's arm and shoulder to prevent loss of circulation.

Another advantage of the present invention is a pillow which may be reversed to accommodate a sleeper sleeping on the sleeper's stomach having one or both arms in a natural position under the pillow while reducing pressure and loss of circulation to the sleeper's arms.

DETAILED SPECIFICATION

Figure 1:
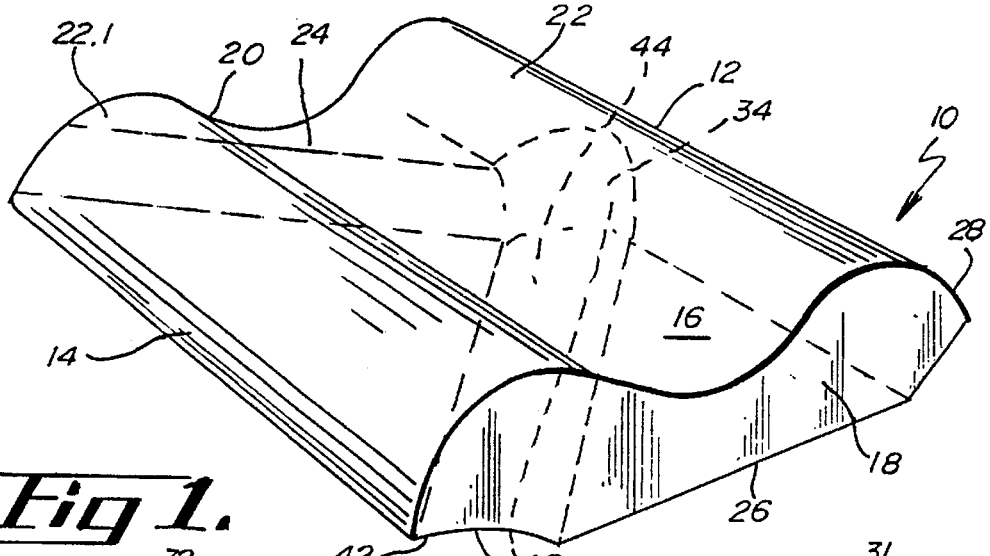
FIG. 1 is an elevated perspective view of the cervical pillow.

The pillow 10 as shown in FIG. 1 is formed from a single piece of resilient material such as foam rubber and comprises a front portion 12 and a back portion 14. The front portion 12 is generally closest to a sleeper 51 illustrated in FIG. 5. The pillow also has a top portion 16 and two, generally parallel edges defined as a first side 18 and a second side 20. Each side 18, 20 extends from the front portion 12 to the back portion 14. A neck support 22 is on the top portion 16 and formed by a contour which is elevated adjacent the front portion 12. A head support 24 is on the top portion 16 and intermediate to the front portion 12 and the back portion 14 and adjacent to the neck support 22. A second neck support 22.1 may also be formed on the top portion 16 adjacent to the back portion 14.

Figure 4:
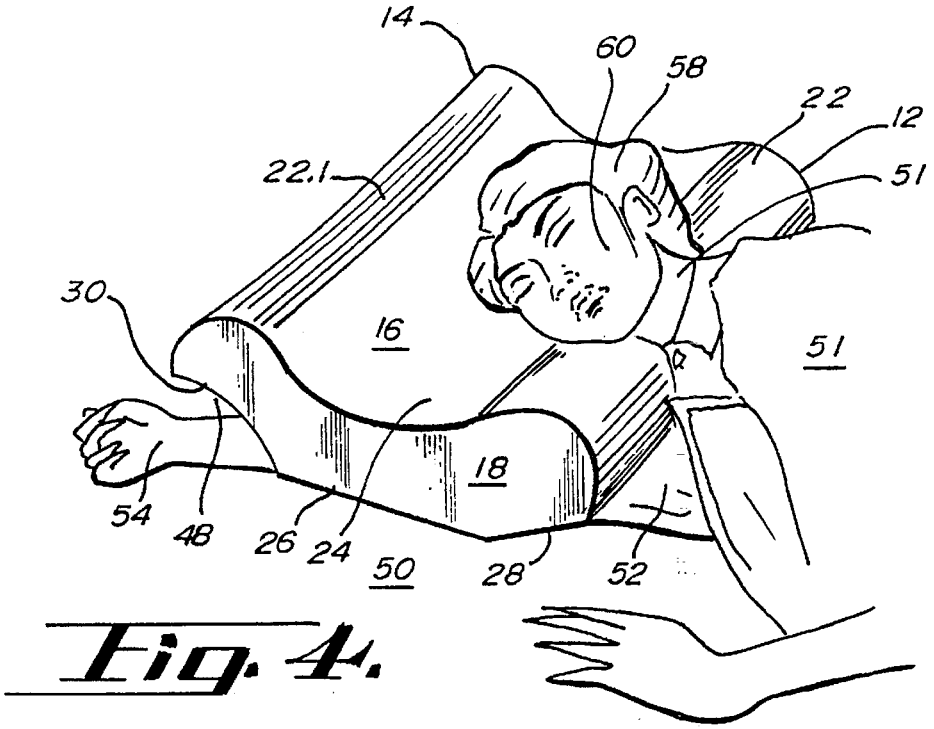
FIG. 4 is a perspective view of a sleeper using the cervical pillow.
Figure 5:
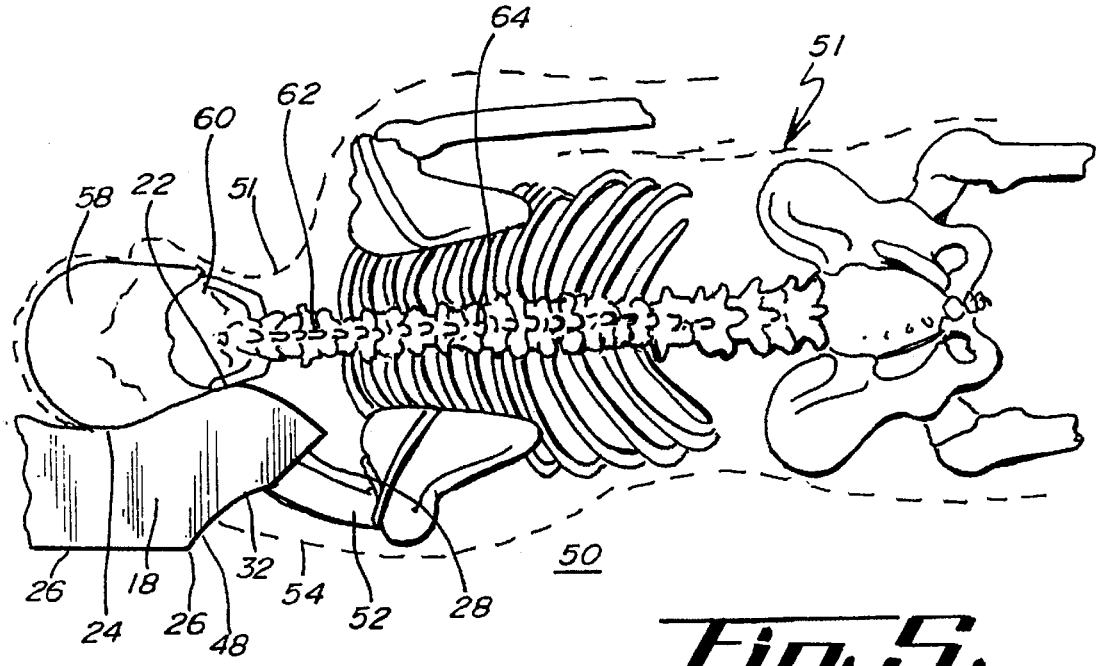
FIG. 5 is a side view of a sleeper using the cervical pillow particularly illustrating the skeletal structure of the sleeper.

As shown in FIGS. 4 and 5, a sleeper 51 may sleep having a lower shoulder 52 under shoulder ledge 28. A lower arm 54 may extend through the arm cavity 48 formed by the first arm channel 30 and the top surface 50 of the bed. The lower arm 54 may be extended partially or completely under the pillow 10 and through the arm cavity 48.

Continuing to refer to FIG. 4, the sleeper 51 has a neck 56 on the neck support 22 and a head 58 on the head support 24. It should be understood, partial or complete extension of the arm through arm cavity 48 will not elevate the head 58 of the sleeper 51. The pillow 10 will maintain proper alignment of the temporomandibular joint 60. As shown in FIG. 5, the pillow will also maintain proper alignment of the cervical spinal area 62 and thoracic spinal area 64.

Figure 2:
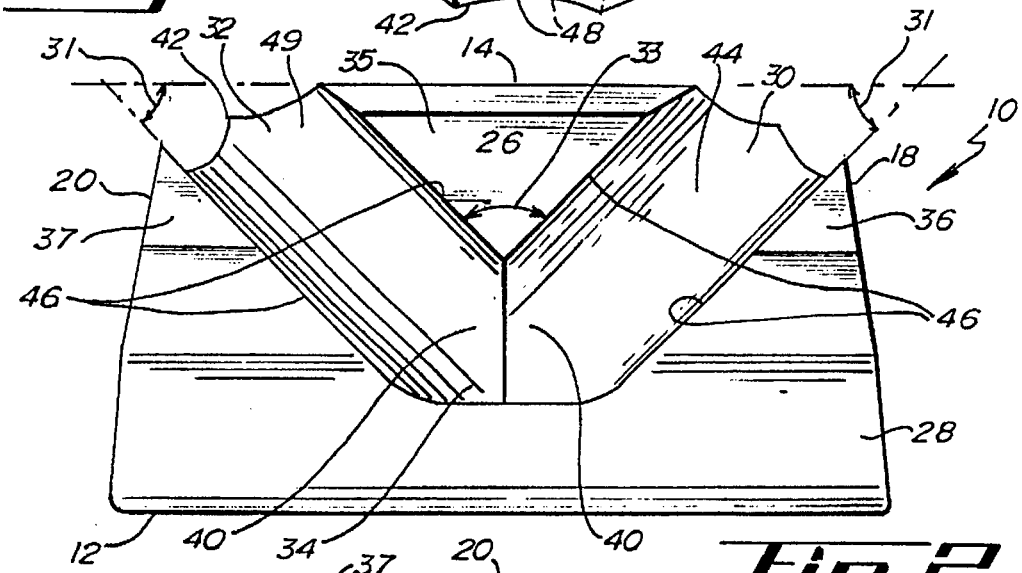
FIG. 2 is an elevated perspective view of the cervical pillow placed on its top to illustrate the bottom portion of the cervical pillow.
Figure 3:
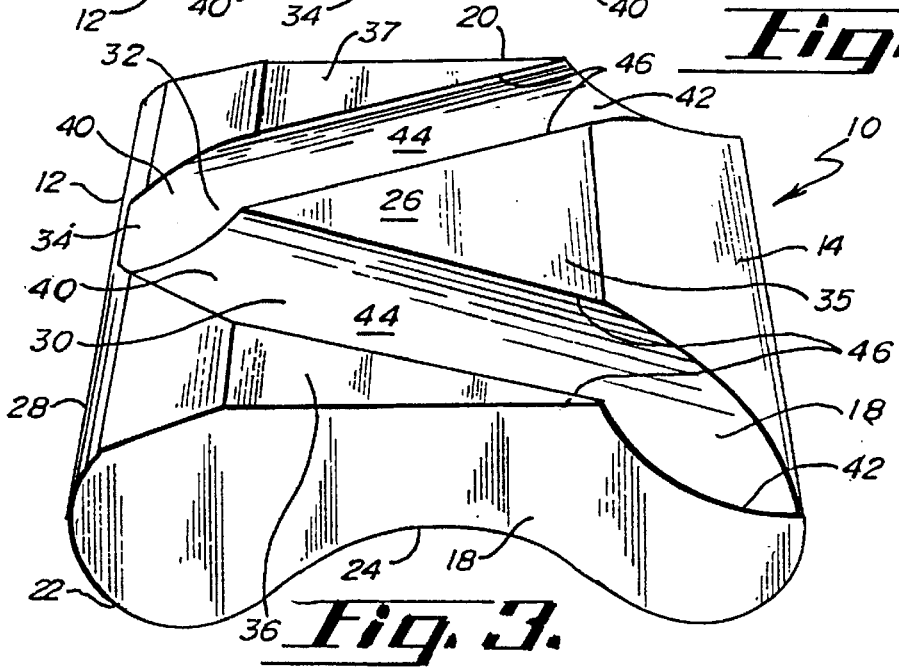
FIG. 3 is an elevational view illustrating the bottom portion of the cervical pillow.

Referring to FIGS. 2 and 3, the pillow 10 has a bottom portion 26. The shoulder ledge 28 extends from the top portion 16 to accommodate the sleeper's lower shoulder 52. The shoulder ledge 28 is defined by the front portion 12 being closer to the sleeper 51 adjacent the top portion 16 of the pillow 10 than the intersection of the bottom portion 26 and the front portion 12 of the pillow 10. The shoulder ledge 28 is adjacent to the neck support 22 and overhangs the front portion 12.

A first arm channel 30 is formed in the surface of the bottom portion 26 of the pillow 10. The first arm channel 30 opens to the front portion 12 of the pillow 10 to allow the sleeper 51 to extend the lower arm 54 into the first arm channel 30. The first angle 31 of the first arm channel 30 with respect to the front portion 12 of the pillow 10 allows a natural extension of the lower arm 54 of the sleeper 51. The first arm channel 30 is positioned at a first angle 31 with respect to the front portion 12 of the pillow 10.

A second arm channel 32 is formed in the surface of bottom portion 26 in a V-orientation with respect to the first arm channel 30 and may also be at the first angle 31 with respect to front portion 12 of the pillow 10. The second arm channel 32 may also open to the front portion 12 of the pillow 10. It should be understood, the natural extension of the lower arm 54 of the sleeper 51 will be accommodated by either the first channel 30 or the second arm channel 32 depending on whether the lower arm 54 is the sleeper's right or left arm.

In the embodiment shown in FIGS. 2 and 3, first arm channel 30 and second arm channel 32 are mirror images of each other. The first arm channel 30 and second arm channel 32 come together at the front portion 12 of the pillow 10 to form a V-shaped pocket 34 in the bottom portion 26 of the pillow. The first and second arm channels 30, 32 respectively are defined by concave surface 44 and channel edges 46.

Central prop portion 35 extends from bottom portion 26 of pillow 10 between the first arm channel 30 and the second arm channel 32. A first peripheral prop portion 36 extends from the bottom portion 26 of the pillow 10 intermediate to the first arm channel 30 and the first side 18. A second peripheral prop portion 37 extends similarly from the bottom portion 26 intermediate to the second arm channel 32 and the second side 20.

The first arm channel 30 and the second arm channel 32 each have a shoulder opening 40 at the front portion 12 of the pillow 10 forming the V-shaped pocket 34. The first arm channel 30 and the second arm channel 32 also have a hand end 42 which may extend through the back portion 14 of the pillow 10.

Referring to FIG. 4, an arm cavity 48 is formed by the first arm channel 30 and a sleeping surface 50. The extension of the arm 54 through the arm cavity 48 will not distort the position of the neck support 22 or the head support 24 as illustrated in FIGS. 5 and 9. The resilient material of the pillow 10 is flexible and yieldable. The pillow 10 will flex to support the head 58 of the sleeper 51.

Referring to FIG. 5, another arm cavity 48 is formed by the second arm cavity 32 and the sleeping surface 50. Each arm cavity 48 has a size sufficient to accommodate the lower arm 54 to allow the sleeper 51 to remove the lower arm 54 and change positions while sleeping. The shoulder ledge 28 accommodates the sleeper's lower shoulder 52 while the neck support 22 supports the cervical spinal area 62 and allows the thoracic spinal area 64 to maintain proper alignment. The head support 24 supports the head 58 of the sleeper 51 to also maintain proper alignment of the temporomandibular joint 60. The lower arm 54 may be retracted from the arm cavity 48, allowing the sleeper 51 to roll to the sleeper's back while maintaining the neck 56 on the neck support 22 and the head 58 on the head support 24.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. A one-piece pillow comprising a top portion having a head support thereon, a front portion on the pillow, a bottom portion on the pillow, and a back portion on the pillow, a first arm channel formed in the bottom portion of the pillow, the first arm channel having a shoulder opening at the from portion of the pillow, a second arm channel formed in the bottom portion of the pillow, the second arm channel having a shoulder opening adjacent to the shoulder opening on the first arm channel, the shoulder opening on the second arm channel extending to the front portion of the pillow, the first arm channel and the second arm channel formed in a V-orientation to each other, and the pillow formed from a resiliently flexible material.

2. The pillow of claim 1 wherein the first arm channel extends through the back portion of the pillow.

3. The pillow of claim 1 further comprising a neck support on the top portion of the pillow and a shoulder ledge extending from the top portion of the pillow adjacent the neck support.

4. The pillow of claim 1 further comprising a central prop portion on the bottom portion of the pillow between the first arm channel and the second arm channel.

5. The pillow of claim 1 wherein the first arm channel comprises a hand end extending to the back portion of the pillow, the second arm channel comprises a hand end extending to the back portion of the pillow, the hand end of the first arm channel spaced from the hand end of the second arm channel.

6. The pillow of claim 5 further comprising a V-shaped pocket at the bottom portion of the pillow formed by the shoulder opening of the first arm channel and the shoulder opening of the second arm channel.

7. The pillow of claim 1 further comprising a shoulder ledge extending from the top portion of the pillow over the shoulder opening of the first arm channel and the shoulder opening of the second arm channel.

8. The pillow of claim 1 further comprising a neck support intermediate to the front portion of the pillow and the head support.

9. A combination pillow and bed comprising:

a) a top surface on the bed;

b) the pillow formed from a resiliently flexible material, the pillow having a front portion, back portion, top portion and bottom portion, the bottom portion having a plurality of prop portions bearing against the top surface of the bed; and c) a first arm channel formed in the bottom portion of the pillow adjacent one of the prop portions and extending from the front portion of the pillow to the back portion of the pillow, the first arm channel formed at an oblique angle to the front portion of the, pillow, an arm cavity defined by the first arm channel in the pillow and the top surface on the bed.

10. The bed and pillow of claim 9 further comprising a shoulder ledge on the pillow extending over the front portion of the pillow.

11. The bed and pillow of claim 9 further comprising a head support on the top portion of the pillow.

12. The bed and pillow of claim 11 further comprising a neck support on the top portion of the pillow between the front portion of the pillow and the head support.

13. The bed and pillow of claim 9 further comprising a neck support on the top portion of the pillow adjacent to the front portion of the pillow.

14. The bed and pillow of claim 9 further comprising a second arm channel formed in the bottom portion of the pillow having a shoulder opening extending through the front portion of the pillow, the second arm channel formed in a V-orientation to the first arm channel.

15. The bed and pillow of claim 14 further comprising a central prop portion on the bottom portion of the pillow between the first arm channel and the second arm channel.

16. The bed and pillow of claim 14 further comprising a V-shaped pocket opening to the front portion of the pillow and in communication with the shoulder opening of the first arm channel and the shoulder opening of the second arm channel.

17. The bed and pillow of claim 15 further comprising a first peripheral prop portion on the bottom portion of the pillow adjacent to the first arm channel, a second peripheral prop portion on the bottom of the pillow adjacent to the second arm channel, a V-shaped pocket formed in the bottom portion of the pillow, the V-shaped pocket opening to the front portion of the pillow between the shoulder opening of the first arm channel and the shoulder opening of the second arm channel.

18. The bed and pillow of claim 17 further comprising a shoulder ledge extending from the top portion of the pillow, the shoulder ledge overhanging the front portion, a neck support on the top portion adjacent to the shoulder ledge, a head support on the top portion adjacent to the neck support.

19. The bed and pillow of claim 13 further comprising a second neck support on the top portion of the pillow adjacent to the back portion.

20. A cervical pillow comprising:

a) the pillow formed from a resiliently flexible material, a bottom portion, a top portion, a front portion and a back portion on the pillow;

b) a neck support on the top portion of the pillow adjacent to the front portion of the pillow;

c) a head support on the top portion of the pillow adjacent to the neck support;

d) a first arm channel formed in the bottom portion of the pillow, the first arm channel having a shoulder opening extending through the front portion of the pillow and a hand end in the back portion of the pillow;

e) a second arm channel formed on the bottom portion of the pillow having a shoulder opening extending through the front portion of the pillow by the shoulder opening of the first arm channel, a hand end on the second arm channel in the back portion of the pillow, the hand end of the second arm channel spaced from the hand end of the first arm channel, the first arm channel and the second arm channel formed in a V-orientation to each other; and f) a central prop portion between the first arm channel and the second arm channel whereby a sleeper having a head, a neck, a side, a shoulder, and a lower arm and may sleep on the sleeper's side having the head of the sleeper supported by the head support and the neck of the sleeper supported by the neck support and the lower arm of the sleeper extended through one of the first or second arm channels.

* * * * *